US007134250B2

(12) United States Patent
Forrester et al.

(10) Patent No.: US 7,134,250 B2
(45) Date of Patent: Nov. 14, 2006

(54) BUILDING PANELS

(75) Inventors: Trevor Forrester, Undercliffe (AU); Michel Bostrom, Dee Why (AU)

(73) Assignee: Amalgamated Metal Industries Pty Ltd., New South Wales (AU)

( * ) Notice: Subject to any disclaimer, the term of this patent is extended or adjusted under 35 U.S.C. 154(b) by 175 days.

(21) Appl. No.: 10/258,393

(22) PCT Filed: Apr. 24, 2001

(86) PCT No.: PCT/AU01/00467

§ 371 (c)(1),
(2), (4) Date: Mar. 21, 2003

(87) PCT Pub. No.: WO01/83904

PCT Pub. Date: Nov. 8, 2001

(65) Prior Publication Data

US 2003/0159400 A1 Aug. 28, 2003

(30) Foreign Application Priority Data

Jan. 13, 2000 (AU) ..... PQ5067
Apr. 27, 2000 (AU) ..... PQ7142

(51) Int. Cl.
*E04B 1/74* (2006.01)

(52) U.S. Cl. ..... 52/406.3; 52/406.1; 52/79.5; 52/745.19; 52/783.17

(58) Field of Classification Search ..... 428/119, 428/120, 182, 101, 12, 122; 264/257; 52/745.19, 52/406.1, 406.2, 406.3, 404.3, 745.2, 630, 52/506.01, 79.5, 783.17, 793.11
See application file for complete search history.

(56) References Cited

U.S. PATENT DOCUMENTS 2,101,836 A * 12/1937 Benedict ..... 52/406.3

(Continued)

FOREIGN PATENT DOCUMENTS

AU 511833 * 11/1980

(Continued)

*Primary Examiner*—Basil Katcheves
(74) *Attorney, Agent, or Firm*—Birch, Stewart, Kolasch & Birch, LLP

(57) ABSTRACT

A building or insulating panel (30) including a collapsible frame of generally square or rectangular configuration, which is collapsible between a generally flat condition and an erected condition in which it is installed. The frame including overlying top and bottom sheets (31,32) that are generally parallel and spaced apart in the erected condition of the frame by two webs (33,36) which are spaced apart to extend in generally parallel realationship lengthwise along opposite side regions of the frame. The webs (33, 36) extend substantially perpendicular to the top and bottom sheets (31, 32) in the erected condition and are disposed substantially parallel to the top and bottom sheets (31, 32) in the collapsed condition. The panel further includes reinforcing means (37) which is inserted between the top and bottom sheets (31, 32) when the frame is in the erected condition to reinforce the panel (30) against collapse. The insulating panel may have an intermediate sheet disposed between the top and bottom sheets which is adhesively connected to each of the top and bottom sheets. The intermediate sheet is formed as a corrugated sheet and at least one of the top and bottom sheets and the intermediate sheet are formed from reflective insulating foil to create a reflective air space.

22 Claims, 2 Drawing Sheets

U.S. PATENT DOCUMENTS

Figure 1:
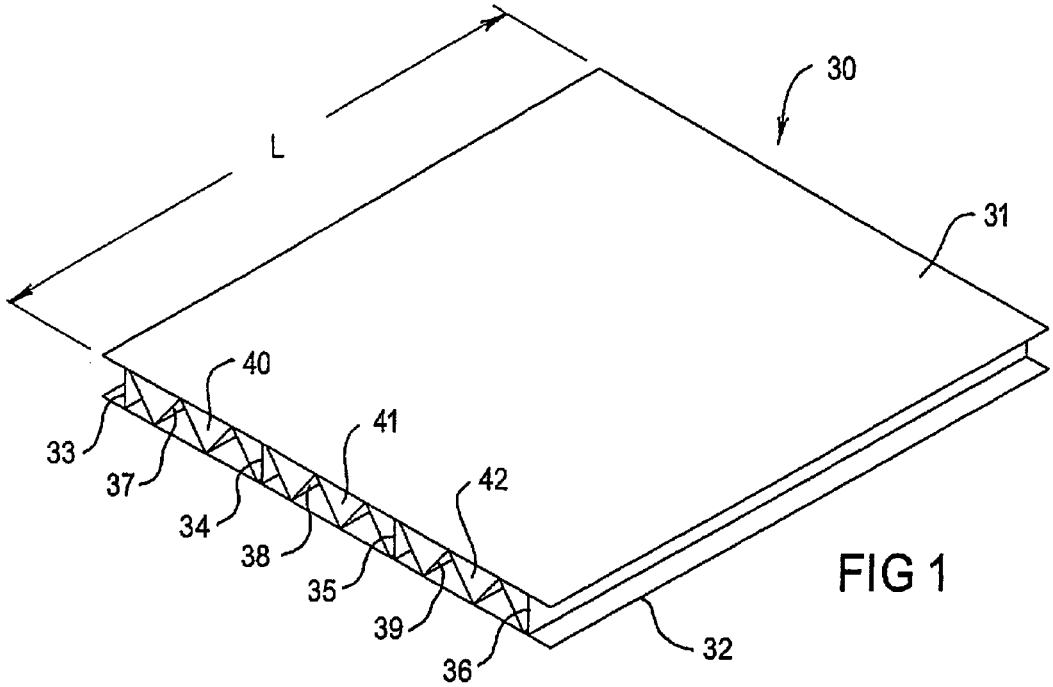

| | | | | | |
|---|---|---|---|---|---|
| 2,221,309 | A | * | 11/1940 | Gazelle | 428/186 |
| 2,750,313 | A | * | 6/1956 | Schwartz et al. | 52/406.3 |
| 2,786,004 | A | * | 3/1957 | Schwartz et al. | 52/406.3 |
| 4,035,539 | A | * | 7/1977 | Luboshez | 428/178 |
| 4,315,962 | A | * | 2/1982 | Skoien | 428/12 |
| 4,414,257 | A | * | 11/1983 | Haraga et al. | 428/182 |
| 5,074,090 | A | | 12/1991 | Hafers | |
| 5,270,092 | A | * | 12/1993 | Griffith et al. | 428/69 |
| 5,670,220 | A | * | 9/1997 | Skoien | 428/12 |
| 5,914,171 | A | * | 6/1999 | Morley | 428/122 |
| 6,033,115 | A | * | 3/2000 | Zeiler | 383/119 |
| 2003/0159400 | A1 | * | 8/2003 | Forrester et al. | 52/783.17 |

FOREIGN PATENT DOCUMENTS

| | | | | |
|---|---|---|---|---|
| AU | 9220847 | | * | 2/1993 |
| AU | 647948 | | * | 3/1994 |
| DE | 628814 | | * | 4/1936 |
| FR | 2480181 | A1 | | 10/1981 |
| GB | 466727 | | * | 6/1937 |
| GB | 482747 | | * | 4/1938 |
| WO | WO 93/04240 | | * | 3/1993 |
| WO | WO 01/83904 | A1 | * | 11/2001 |

* cited by examiner

BUILDING PANELS

This application is the national phase under 35 U.S.C. § 371 of PCT International Application No. PCT/AU01/00467 which has an International filing date of Apr. 24, 2001, which designated the United States of America.

The present invention relates to building panels and to a method and arrangement of installing building panels. The present invention was developed in relation to insulating batts and particularly, although not exclusively, to the construction and installation of insulating batts formed from self-supporting sheets of reflective insulating material. It will therefore be convenient to describe the invention in relation to that style of insulating batt, although it is to be appreciated, that the invention could apply to non-insulating panels and to insulating batts formed differently to or from alternative material to that described above.

Australian Patents Nos. 511833 and 647948 disclose insulating batts having substantially flat, self-supporting sheets of reflective insulating material secured in substantially parallel, overlying relationship. The sheets of those batts are secured relative to each other by parallel webs of sheet material that permit the batt to be adjusted between a collapsed condition to an erected condition. Advantageously, these batts have very little volume when collapsed and can be stored and transported in that condition, for erection on site when being installed generally in a roof of a building.

The installation of the above kinds of insulation batts is not always simple, particularly in relation to commercial buildings, such as warehouses and factories. In those buildings, it is preferable to fit the insulating batts between adjacent purlins and until recently, a suitable method for such installation, which is both simple and effective in respect of the insulation provided, has been unavailable.

According to the present invention there is provided a building panel including a collapsible frame of generally square or rectangular configuration, which is collapsible between a generally flat condition, and an erected condition in which it is installed, said frame including top and bottom sheets that are generally parallel and spaced apart in said erected condition of said frame by two webs which are spaced apart to extend in generally parallel relationship lengthwise along opposite side regions of said frame, said webs extending substantially perpendicular to said top and bottom sheets in said erected condition and being disposed substantially parallel to said top and bottom sheets in said collapsed condition, said panel further including reinforcing means which is inserted between said top and bottom sheets when said frame is in said erected condition to reinforce said panel against collapse.

The present invention further provides a method of installing a building panel having a collapsible frame of generally square or rectangular configuration, which is collapsible between a generally flat condition, and an erected condition, said frame including top and bottom sheets that are generally parallel and spaced apart in said erected condition of said frame by two webs which are spaced apart to extend in generally parallel relationship lengthwise along opposite side regions of said frame, said webs extending substantially perpendicular to said top and bottom sheets in said erected condition and being disposed substantially parallel to said top and bottom sheets in said collapsed condition, said method including transporting said frame to an installation site in said collapsed condition, expanding said frame to said erected condition, inserting reinforcing means between said top and bottom layers of said frame and thereafter placing said panel in position.

The reinforcing means can be of sheet form which is collapsible between a substantially flat condition for transport and an erected condition for installation of the insulating batt, or it can be formed as a member ready for assembly in the frame in a nestable condition in which a plurality of reinforcing means can be nested together for transport to the installation site. In either case, the advantages of the invention is realised by the compact nature of the reinforcing means for transport and production and the simple nature of the assembly process. In either case, the reinforcing means is insertable in the erect condition thereof into the space of the erected frame, where after the insulating batt can be installed.

The invention advantageously is comprised of a collapsible frame and collapsible or nestable reinforcing means each of which can be handled and transported to the site of insulation with substantially reduced bulk compared to the erected condition of the panel or batt. Thus, the components of the insulating batt can be easily handled and transported at minimum cost and are simple to erect and thereafter be installed. This compares with alternative batt structures which are bulky and more difficult to install.

The reinforcing means can be in the form of a corrugated sheet which includes successive oppositely facing peaks extending in contact with each of the top and bottom sheets of the frame for supporting those sheets in a spaced apart disposition. The corrugations could be of a curved configuration, taking a cross-sectional profile similar to a sine wave, or it may have a concertina-like or sawtooth profile which is comprised of a plurality of substantially planar segments disposed at opposite inclined angles, so as to define a succession of adjacent peaks and troughs, with the apex of each peak and trough being in engagement with either the top or bottom sheet of the frame. The strength of the panel or batt when assembled relies partly on the frictional contact between the reinforcing means and the top and bottom sheets of the frame. Thus, a sine wave configuration provides better strength than the sawtooth profile, because the former has greater surface area contact than the edge contact of the latter. An advantage of the present invention is that the reinforcing means need not be fixed within the frame, such as by an adhesive, but can be simply placed or inserted into the frame. This provides for simple assembly which is a feature of the present invention.

The required spacing of the webs is dependent on the grade of paper normally used for construction of the panel or insulating batt. Thus, the use of a heavy paper grade can reduce the need for additional webs between the side edge webs. The reinforcing means and the webs both contribute to the stiffness of the panel or batt and the choice of the material of one can influence the material choice for the other.

It will be appreciated, that the above examples show that the reinforcing means could take a variety of forms. Thus, the form of the reinforcing means is not necessarily critical, but instead what is important, is that the reinforcing means be nestable or alternatively collapsible, so that it may be transported to the insulation site either in a nested or substantially flat form so having the same transport and handling advantages as the frame.

In one arrangement, the frame includes three or more webs extending between the top and bottom sheets of the frame, so dividing the space between the top and bottom sheets into two or more smaller space segments. Therefore, the frame in this arrangement, includes a pair of webs disposed toward opposite side edge regions of the frame and at least one further web disposed intermediate or midway between the two edge webs. In a particularly preferred arrangement, a pair of webs are disposed intermediate the side edge webs.

In the above arrangement, the reinforcing means is arranged to extend between adjacent webs. Thus, in the arrangement in which three webs are disposed between the top and bottom sheets, the reinforcing means is comprised of two separate reinforcing members or components. Those members may be identical in profile or dissimilar as required. Alternatively, in the arrangement in which a pair of intermediate webs is disposed between the side edge webs, three reinforcing members are disposed between the top and bottom sheets of the frame.

In an alternative arrangement, reinforcing means may be disposed in only one of the space segments between adjacent frame webs. That is, in the arrangement in which two intermediate webs are disposed between the side edge webs, thus defining three space segments, each of those space segments may accommodate reinforcing means, or alternatively only one or two of the space segments may accommodate such reinforcing means. The requirement for reinforcing means will depend on the rigidity of the insulating batt which is required.

For example, in the above arrangement in which three space segments are formed, the insulating characteristics of the insulating batt may only require reinforcing means in one of the space segments, and that will facilitate a reduction in the overall cost of the insulating batts. Alternatively, if the insulating batt has a length or width of such dimensions that require each of the space segments to accommodate reinforcing means, then such means can easily be included. Therefore, the insulating batt of the invention is flexible in its requirement for reinforcing means, depending on the insulating characteristics required, and the structural requirements.

A batt of the above described kind provides general advantages in relation to storage and transport, because it can be stored and shipped in a collapsed form. It further provides advantages in production, because it is very easy to manufacture, assemble and install. The panel of the invention is particularly suited to installation in ceilings, in particular so-called suspended T-bar ceilings generally found in commercial office space. The panel can replace presently used acoustic or plasterboard tiles at a much lower cost. Additionally, the panel can be formed as an insulating batt, which further enhances its use as a ceiling panel.

The use of reflective insulating foil provides a particular advantage of the present invention over acoustic and plasterboard panels now employed, in that reflective foil is waterproof. Accordingly, ceiling or wall leakage will not necessarily destroy or affect the performance of the panel as it may with non-waterproof panels, which include the aforementioned acoustic and plasterboard kind. This advantage of the present invention extends to installation sites in regions of high humidity also, such that a panel of the invention, formed fully or partly from reflective insulating foil, may be preferred in such regions.

According to the present invention, there is further provided an insulating batt having top and bottom sheets and an intermediate sheet which is disposed between the top and bottom sheets and which is adhesively connected to each of those sheets, the intermediate sheet being formed as a corrugated sheet and at least one of the top and bottom sheets and the intermediate sheet being from reflective insulating foil, to create a reflective air space.

The above insulating batt can be manufactured by applying the corrugated intermediate sheet adhesively to one of the top and bottom sheets and then adhesively applying the other of the top and bottom sheets to the intermediate sheet. Like the earlier described batt, this batt is simple to manufacture and install and, as it is envisaged that it would having industry acceptable insulating characteristics in an overall thickness of about 25 mm, it would also be attractive for storage, transport and installation.

An insulating batt according the invention is suitable for insulating a variety of structures, such as wall and roof structures. The insulating batts of the invention can be installed in a progressive manner, by installing an insulating batt between adjacent purlins and pushing that batt along the length of the purlins with successive batts. The batts according to the invention can be fixed to the purlins in any suitable manner or they may simply rest under their own weight without sagging, by employment of the reinforcing means.

The attached drawings show example embodiments of the invention of the foregoing kind. The particularity of those drawings and the associated description does not supersede the generality of the preceding broad description of the invention.

FIG. 1 shows an insulating batt 30 which includes a frame having top and bottom layers 31 and 32 respectively which are generally rectangular and disposed in parallel, overlying relationship. The top and bottom layers may be made of a double-sided foil laminate which in its planar form, is relatively flexible, although the invention is not restricted to such a material and alternative materials may be employed. Materials such as those described in Australian patents 511833 and 647948 are suitable for use in the construction of the insulating batt 30.

The frame of the insulating batt 30 further comprises a plurality of webs 33 to 36 which are disposed to extend lengthwise of the batt 30 and substantially at right angles to the top and bottom layers 31 and 32. The webs 33 to 36 can pivot relative to the top and bottom layers 31 and 32, to permit the batt 30 to collapse from the erected condition shown in FIG. 1 to a collapsed condition, in which the webs are substantially parallel to the layers 31 and 32. Thus, the webs are connected to the top and bottom layers 31 and 32 in a manner to permit such pivoting movement and such an arrangement or construction is disclosed in the aforementioned Australian patents. Therefore, that construction can be employed in an insulating batt according to the invention, or alternative constructions can be employed that permit the same collapsible movement.

The insulating batt 30 of FIG. 1 includes four webs as shown. However, the invention is only required to include webs 33 and 36 disposed along the side edges of the frame of the batt 30. The intermediate webs 34 and 35 can be provided as required to suit the necessary structural characteristics of the batt 30.

Between each of the webs illustrated in FIG. 1, is reinforcing means in the form of corrugated insulating sheet reinforcing components 37 to 39. Each of the members 37 to 39 is formed with a plurality of inclined planar sections as shown, which meet to form adjacent oppositely pointing apexes in contact respectively with the inside surfaces of the top and bottom sheets 31 and 32. The reinforcing members 37 to 39 also extend into contact with the webs 33 to 36. The reinforcing members 37 to 39 support the frame of the insulating batt 30 lengthwise against sagging. Thus, the batt 30 has considerable rigidity in the longitudinal direction L so that the batt 30 can be made to span greater distances than would otherwise be possible without the members 37 to 39.

Additionally, the use of an insulating sheet as a medium for the reinforcing members 37 to 39 facilitates better insulating performance than in absence of those sheets. Thus, the corrugated insulating reinforcing members 37 to 39 have a dual function.

Figure 1A:
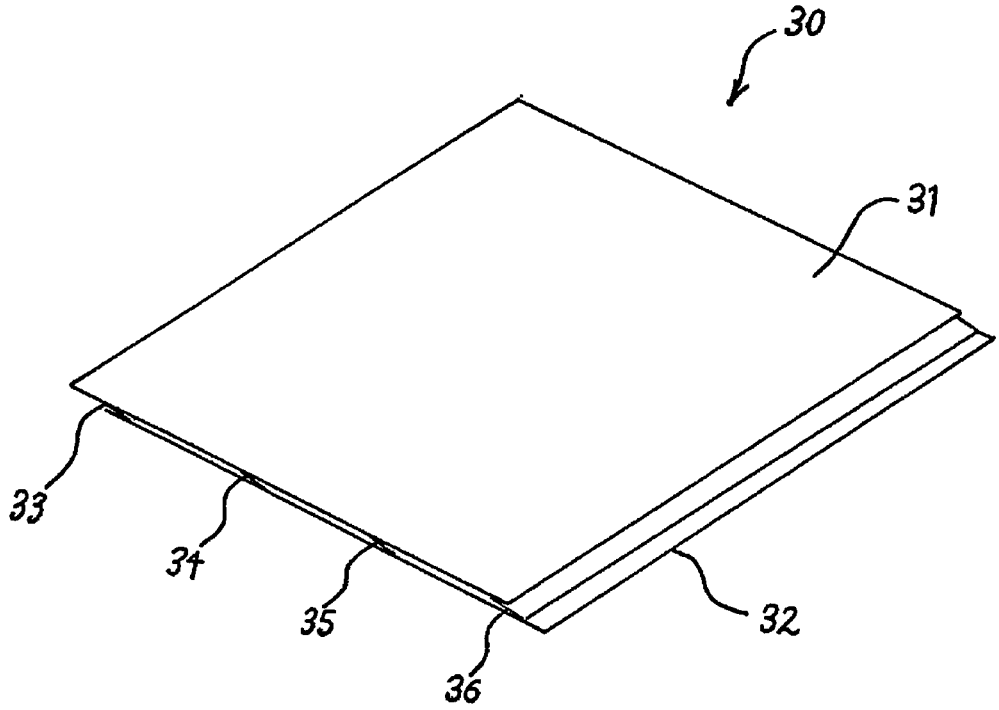

The insulating batt 30 is advantageously collapsible, by removal of the corrugated reinforcing members 37 to 39 where after the frame of the batt 30 can be collapsed to a flat condition. FIG. 1*a* shows the insulating batt 30 in a collapsed condition, with the reinforcing members 37 to 39 removed. The members 37 to 39 can be nested together. Thus, at the site of installation, it is a simple matter of erecting the frame of the batt 30, and inserting the reinforcing members 37 to 39 into the space segments 40 to 42 between the top and bottom layers 31 and 32, after which the batt is ready for installation.

Figure 2:
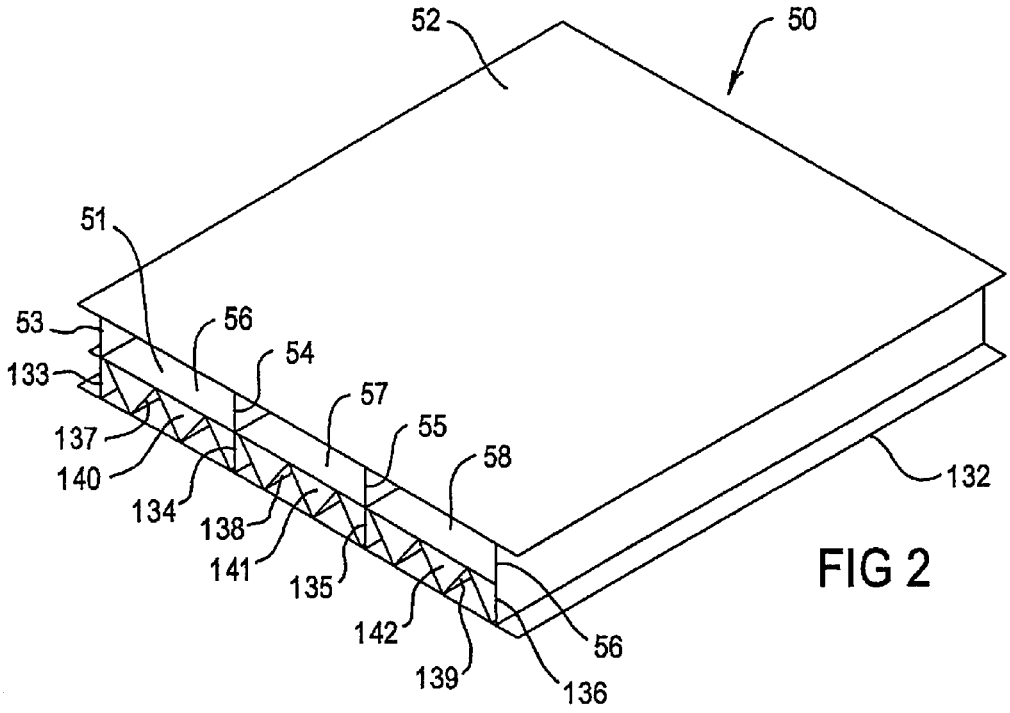

FIG. 2 shows an alternative insulating batt 50 which has some characteristics of the insulating batt 30 of FIG. 1 and therefore like parts will have the same reference numeral plus 100. The batt 50 however differs from the batt 30, by way of the addition of a second layer such that the batt 50 includes a bottom layer 132, and intermediate layer 51 and a top layer 52. Such a batt can be manufactured according to the methods disclosed in Australian patent nos. 511833 and 647948. Thus, the batt 50 includes webs 53 to 56 extending between the intermediate layer 51 and the top layer 52. The webs 53 and 56 may be continuations of the webs 133 to 136, although manufacturing limitations are likely to require that the webs 54 and 55 be separately formed from the webs 134 and 135.

In the arrangement shown in FIG. 2, reinforcing members 137, 138 and 139 are disposed in the space segments 140, 141 and 142. No reinforcing members are disposed in the spaces 56 to 58, although if required reinforcing members could be inserted in these spaces. Thus, the insulating batt 50 illustrates the flexibility that the present invention provides. For example, if further reinforcement was required, reinforcing members could be included in only one of the space segments 56 to 58, or in two or in each of those space segments. Thus, if the insulating characteristics of the batt 50 were required to be higher than that achievable by the arrangement illustrated in FIG. 2, then the addition of further corrugated reinforcing members disposed in one or more of the space segments 56, 57 and 58 may achieve those requirements.

FIG. 2 illustrates the flexibility that the present invention can provide. The invention can therefore be applied for example, to a four layer insulating batt and the reinforcing members can be applied to each or any selection of the space segments within the batt as considered appropriate. The reinforcing members can be made of any suitable material and could for example be made of cardboard or stiff paper if the requirement of the reinforcing members was to provide rigidity only and little if no insulating characteristics. In the preferred arrangement however, the reinforcing members are constructed out of the same material as the frame of the insulating batt so as to enhance the insulating capability of each batt.

Figure 3:
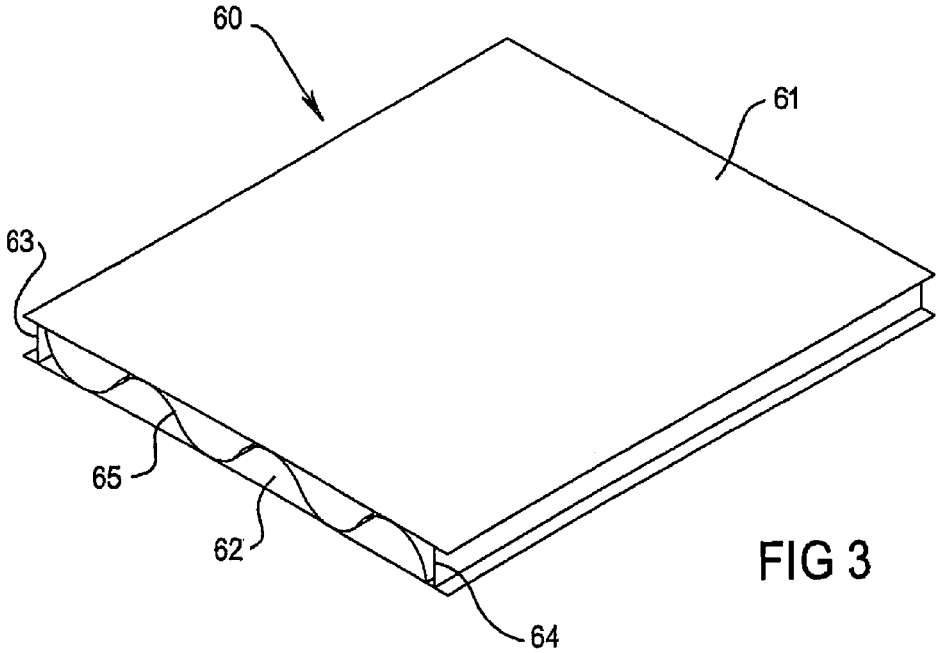

FIG. 3 illustrates a further alternative insulating batt 60, which, similar to the batt 30 of FIG. 1, has top and bottom layers 61 and 62 and webs 63 and 64. The batt 60 is collapsible in the manner of the batt 30 and in the form illustrated, the batt 60 is erect and includes corrugated reinforcing means 65 which is of generally curved form. The reinforcing means 65 has the reinforcing function of the reinforcing members 37 to 39 of the batt 30 and is removably insertable between the top and bottom layers 61 and 62.

The invention described herein is susceptible to variations, modifications and/or additions other than those specifically described and it is to be understood that the invention includes all such variations, modifications and/or additions which fall within the spirit and scope of the above description.

The invention claimed is:

1. A method of assembling a building panel, the method comprising the steps of: providing a collapsible frame of generally square or rectangular configuration, which is collapsible between a generally flat condition, and an erected condition, said frame including overlying top and bottom sheets that are generally parallel and spaced apart in said erected condition of said frame by two webs which are spaced apart to extend in generally parallel relationship lengthwise along opposite side regions of said frame, said webs extending substantially perpendicular to said top and bottom sheets in said erected condition and being disposed substantially parallel to said top and bottom sheets in said collapsed condition, expanding said frame to said erected condition and thereafter inserting reinforcing means between said top and bottom sheets, the reinforcing means and the wens extending lengthwise along entire lengths of the opposite side regions of said frame; and placing said erected building panel in an installed position in a building.

2. A method according to claim 1, said reinforcing means being of sheet form and being collapsible between a generally flat condition and an erected condition, said reinforcing means being formed into said erected condition for insertion between said top and bottom sheets of said frame.

3. A method according to claim 1, said reinforcing means being formed as a member which is shaped ready for insertion between said top and bottom sheets of said frame, said shape of said reinforcing member being such as to permit nesting between a plurality of said reinforcing members.

4. A method according to claim 1, said reinforcing means having a corrugated form for insertion into said frame, said corrugated form defining successive oppositely facing peaks respectively extending into contact with said top and bottom sheets of said frame.

5. A method according to claim 4, said corrugated form being of generally curved form.

6. A method according to claim 4, said corrugated form comprising a generally sawtooth profile.

7. A method according to claim 4, said reinforcing means being arranged to engage said webs.

8. A method according to claim 1, said panel including at least a further web disposed between said webs at said opposite side regions of said frame and extending generally parallel thereto and substantially perpendicular to said top and bottom sheets in said erected condition of said frame and being disposed substantially parallel to said top and bottom sheets in said collapsed condition of said frame, said reinforcing means being provided between at least one pair of adjacent webs.

9. A method according to claim 8, wherein said at least a further web is a single further web.

10. A method according to claim 9, wherein said further web is disposed substantially midway between said webs at said opposite side regions.

11. A method according to claim 8, including a pair of further webs.

12. A method according to claim 1, said frame including an intermediate sheet disposed intermediate and substantially parallel to said top and bottom layers and having plan dimensions substantially the same thereas and said webs being arranged to support said top and bottom sheets and said intermediate sheet in spaced apart relationship.

13. A method according to claim 1, said top and bottom sheets and said webs being formed of cardboard or cardboard-like material.

14. A method according to claim 1, said panel being formed as an insulating batt, in which said top and bottom layers are formed from reflective insulating material.

15. A method according to claim 14, wherein said reinforcing means is formed from reflective insulating material.

16. A panel made according to the method of claim 1.

17. A method of installing a building panel, the method comprising: providing a collapsible frame of generally square or rectangular configuration, which is collapsible between a generally flat condition, and an erected condition, said frame including overlying top and bottom sheets that are generally parallel and spaced apart in said erected condition of said frame by two webs which are spaced apart to extend in generally parallel relationship lengthwise along opposite side regions of said frame, said webs extending substantially perpendicular to said top and bottom sheets in said erected condition and being disposed substantially parallel to said top and bottom sheets in said collapsed condition; and as a first step, either of 1-transporting said frame to an installation site, or 2-expanding said frame to said erected condition and thereafter inserting reinforcing means between said top and bottom layers of said frame, the reinforcing means and the webs extending lengthwise along entire lengths of the opposite side regions of said frame then conducting the other of these steps and thereafter placing said erected building panel in an installed position in a building.

18. A method according to claim 17, wherein said transportation step is the first step conducted and for that step, said frame is transported in said collapsed condition.

19. A method according to claim 17, said reinforcing means being collapsible between a generally flat condition and an erected condition, said method including transporting said reinforcing means in said flat condition to said installation site and thereafter expanding said reinforcing means to said erected condition prior to insertion thereof into said frame.

20. A method according to claim 17, said reinforcing means being formed as a member which is nestable with other reinforcing members and said method including transporting a plurality of said reinforcing members to said installation site in a nested condition.

21. A method according to claim 17, said panel being an insulating batt.

22. A panel made according to the method of claim 17.

* * * * *